US012674601B2

(12) United States Patent
Manole

(10) Patent No.: US 12,674,601 B2
(45) Date of Patent: Jul. 7, 2026

(54) AIR CONDITIONER CONTAINING DRAIN PAN AND REFRIGERANT SENSOR

(71) Applicant: Mitsubishi Electric US, Inc., Cypress, CA (US)

(72) Inventor: Dan Mihai Manole, Suwanee, GA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 239 days.

(21) Appl. No.: 18/622,451

(22) Filed: Mar. 29, 2024

(65) Prior Publication Data

US 2025/0305716 A1 Oct. 2, 2025

(51) Int. Cl.
*F24F 13/22* (2006.01)
*F24F 11/36* (2018.01)

(52) U.S. Cl.
CPC ..... *F24F 13/222* (2013.01); *F24F 11/36* (2018.01)

(58) Field of Classification Search
CPC ..... F24F 11/36; F24F 13/20; F24F 13/222
See application file for complete search history.

(56) References Cited

U.S. PATENT DOCUMENTS

| | | | | |
|---|---|---|---|---|
| 4,922,423 | A * | 5/1990 | Koomey | E21B 33/063 166/373 |
| 8,695,404 | B2 | 4/2014 | Kadle et al. | |
| 10,126,013 | B2 | 11/2018 | Yamamoto | |
| 11,441,813 | B2 | 9/2022 | Tsuji et al. | |
| 2021/0348820 | A1* | 11/2021 | Kobayashi | F25B 25/005 |
| 2023/0417435 | A1* | 12/2023 | Epperson | F24F 13/222 |
| 2024/0240819 | A1* | 7/2024 | Bhardwaj | F24F 11/36 |

FOREIGN PATENT DOCUMENTS

| | | | | |
|---|---|---|---|---|
| EP | 3214383 | B1 * | 1/2020 | F24F 11/36 |
| JP | 2016-075435 | A | 5/2016 | |
| JP | 2022-125771 | A | 8/2022 | |

* cited by examiner

*Primary Examiner* — Henry T Crenshaw
(74) *Attorney, Agent, or Firm* — Posz Law Group, PLC

(57) ABSTRACT

An air conditioner is provided, comprising: a drain pan including plurality of drain pan walls forming an outer circumference of the drain pan, and a drain pan bottom, connected to each of the plurality of drain pan walls such that the plurality of drain pan walls and the drain pan bottom form a basin capable of collecting liquid; and a refrigerant sensor arranged proximate to a first outer surface of a first drain pan wall selected from the plurality of drain pan walls, the refrigerant sensor being configured to detect refrigerant in air proximate to the drain pan. The first drain pan wall includes a first recess on the first outer surface, and the refrigerant sensor is located in the first recess.

20 Claims, 8 Drawing Sheets

AIR CONDITIONER CONTAINING DRAIN PAN AND REFRIGERANT SENSOR

TECHNICAL FIELD

The disclosed systems relate generally to air conditioners that include a refrigerant sensor within a housing of the air conditioner. Specifically, the disclosed systems relate to air-conditioners that include a refrigerant sensor that is both inside the air conditioner housing and proximate to a drain pan provided in the air conditioner housing.

BACKGROUND

An air conditioner will generally include a heat exchanger, which may include coils through which a refrigerant flows, e.g., an A-coil. One common type of refrigerant used by such air conditioners is an A2L refrigerant such as R414B or R32. The designation A2L indicates that the refrigerant is non-toxic (A), is flammable (2), and has a low burning velocity (L). Other refrigerants may also be used, with varying parameters. For example, other non-flammable refrigerants such as R410a or R-407C can be used as well as flammable refrigerant R290 (propane).

In the air conditioner, the refrigerant is cooled in a cooling operation and heated in a heating operation, and air is passed over the coils. This causes the air to exchange heat with the refrigerant passing through the coils and be either heated or cooled depending upon the type or operation being performed.

During heating and cooling operations, a coil-based heat exchanger can leak refrigerant into the air surrounding the heat exchanger. This often happens where pipes are brazed, though other types of leaks are also possible.

Leaks in a heat exchanger coil are undesirable for several possible reasons. First, if the refrigerant used in air conditioners is toxic, leaked refrigerant may cause a health hazard to people in the building containing the air conditioner. Leaked refrigerant from the air conditioner can be blown into the area being heated or cooled and may be breathed by those inside that the building containing the air-conditioner. Second, if the refrigerant is flammable, leaked refrigerant can increase the fire risk in the building containing the air-conditioner. Third, since the proper operation of a coil-based heat exchanger requires sufficient refrigerant pass through the coils, a leakage of refrigerant can cause the air conditioner to function less efficiently. Fourth, leaked refrigerant must be replaced, meaning that a refrigerant leak will result in additional costs for operating the air conditioner.

As a result, many air conditioners contain refrigerant sensors to detect refrigerant leaks so that they can be identified and corrected quickly, and so avoid or minimize the problems identified above.

However, it is also desirable to make air conditioners as small as possible to minimize the amount of space they take up in a building. It is therefore desirable to provide a refrigerant sensor that takes up as little space as possible.

SUMMARY OF THE INVENTION

According to one or more embodiments, an air conditioner is provided, comprising: a drain pan including plurality of drain pan walls forming an outer circumference of the drain pan, and a drain pan bottom, connected to each of the plurality of drain pan walls such that the plurality of drain pan walls and the drain pan bottom form a basin capable of collecting liquid; and a refrigerant sensor arranged proximate to a first outer surface of a first drain pan wall selected from the plurality of drain pan walls, the refrigerant sensor being configured to detect refrigerant in air proximate to the drain pan, wherein the first drain pan wall includes a first recess on the first outer surface, and the refrigerant sensor is located in the first recess.

The first recess has a first width in a first direction parallel to the first outer surface, and the refrigerant sensor has a sensor width in the first direction. The first width of the first recess may be larger than the sensor width of the refrigerant sensor.

The first recess has a first depth in a second direction perpendicular to the first outer surface, and the refrigerant sensor has a sensor depth in the second direction. The second depth of the first recess may be larger than the sensor depth of the refrigerant sensor.

The refrigerant sensor may be attached to the first drain pan wall.

The air conditioner may further comprise a shelf located beneath the drain pan upon which the drain pen rests, and the refrigerant sensor may be attached to the shelf.

The air conditioner may further comprise a heat exchanger formed above the drain pan.

The heat exchanger may include a plurality of capillary tubes, the plurality of capillary tubes may be brazed on a first side of the heat exchanger, and the first drain pan wall may correspond to the first side of the heat exchanger.

The air conditioner may be arranged in a vertical orientation in which air passes through the heat exchanger vertically.

The air conditioner may further comprise an air-conditioner housing containing the drain pan; and a clip configured to affix the drain pan to the air-conditioner housing, the clip being arranged in the first recess.

The air conditioner may further comprise an air-conditioner housing containing the drain pan. The air-conditioner housing may include an access panel on a first housing wall with the first direction being substantially perpendicular to a widest surface of the access panel, and the first outer surface of the first drain pan wall may face the access panel.

An air conditioner may be provided, comprising: a drain pan including plurality of drain pan walls forming an outer circumference of the drain pan, and a drain pan bottom, connected to each of the plurality of drain pan walls such that the plurality of drain pan walls and the drain pan bottom form a basin capable of collecting liquid; a refrigerant sensor located proximate to a first outer surface of a first drain pan wall selected from the plurality of drain pan walls, the refrigerant sensor being configured to detect refrigerant in air proximate to the drain pan; and an air-conditioner housing containing the drain pan, wherein the drain pan has a first drain pan width in a first direction, the air-conditioner housing has a first housing width in the first direction, the refrigerant sensor has a first sensor width in the first direction, the refrigerant sensor and the drain pan are arranged along a line in the first direction, and a sum of the first drain pan width and the first sensor width is less than the first housing width.

The refrigerant sensor may be attached to the first outer surface of the first drain pan wall.

The refrigerant sensor may be attached to the air-conditioner housing.

The air conditioner may further comprise a sensor casing attached to the first drain pan wall, the sensor casing being configured to at least partially enclose the refrigerant sensor.

The sensor casing may include a casing top wall formed above the refrigerant sensor, and at least one casing side wall formed adjacent to the refrigerant sensor at a level below the casing top wall.

The sensor casing may further include a casing front wall formed adjacent to the refrigerant sensor at a level below the casing top wall, the casing front wall being substantially parallel to the first drain pan wall and being attached to at least one of the casing top wall and the at least one casing side wall.

The sensor casing may further include a casing bottom wall formed below the refrigerant sensor, and at least one casing side wall formed adjacent to the refrigerant sensor at a level above the casing bottom wall.

The sensor casing may further include a casing front wall formed adjacent to the refrigerant sensor at a level above the casing bottom wall, the casing front wall being substantially parallel to the first drain pan wall and being attached to at least one of the casing bottom wall and the at least one casing side wall.

The air conditioner may further comprise a shelf located inside the air-conditioner housing and beneath the drain pan upon which the drain pen rests, wherein the refrigerant sensor is attached to the shelf.

The air conditioner may further comprise a sensor casing attached to the shelf, the sensor casing being configured to at least partially enclose the refrigerant sensor.

The refrigerant sensor may be arranged in between the first drain pan wall and the air-conditioner housing and may be held in place by pressure between the first drain pan wall and the air-conditioner housing.

The air conditioner may further comprise a heat exchanger formed above the drain pan.

The heat exchanger may include a plurality of capillary tubes, the plurality of capillary tubes may be brazed on a first side of the heat exchanger, and the first drain pan wall may correspond to the first side of the heat exchanger.

The air conditioner may be arranged in a horizontal orientation in which air passes through the heat exchanger horizontally.

The air conditioner may be arranged in a vertical orientation in which air passes through the heat exchanger vertically.

The air-conditioner housing may include an access panel on a first housing wall, the first direction being substantially perpendicular to a widest surface of the access panel, and the refrigerant sensor may be located between the drain pan and the access panel.

An air conditioner is provided, comprising: a drain pan including plurality of drain pan walls forming an outer circumference of the drain pan, a drain pan bottom, connected to each of the plurality of drain pan walls such that the plurality of drain pan walls and the drain pan bottom form a basin capable of collecting liquid, and a well connected to the drain pan bottom, the well forming an internal space separate from the basin, such that the liquid in the basin cannot pass into the internal space; a refrigerant sensor formed in the well; and an air-conditioner housing containing the drain pan, wherein the drain pan has a first drain pan width in a first direction, the air-conditioner housing has a first housing width in the first direction, the refrigerant sensor has a first sensor width in the first direction, the refrigerant sensor and the drain pan are arranged along a line in the first direction, and a sum of the first drain pan width and the first sensor width is less than the first housing width.

The air conditioner may further comprise a heat exchanger formed above the drain pan.

The heat exchanger may include a plurality of capillary tubes, the plurality of capillary tubes may be brazed on a first side of the heat exchanger, and the well may be formed closer to a first drain pan wall selected from the plurality of drain pan walls and corresponding to the first side of the heat exchanger than to a second drain pan wall selected from the plurality of drain pan walls and opposite to the first drain pan wall.

The air conditioner may be arranged in a horizontal orientation in which air passes through the heat exchanger horizontally.

The well may have an oval cross section in a plane parallel to a plane of the drain pan bottom.

The drain pan may further include a well covering formed over the well such that liquid cannot drip from above the well into the internal space, and the well covering may be formed to allow air to pass from the drain pan into the well.

The drain pan may further include a main drain configured to allow the liquid to pass out of the basin, and an auxiliary drain configured to allow the liquid to pass out of the basin, the auxiliary drain being located at a position higher than the main drain, and a top of the well may be higher than the auxiliary drain.

The well may include an opening on a bottom surface of the well.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Refrigerant Sensor Located in an Indentation in the Drain Pan

When working to detect a refrigerant leak in an air conditioner, it is desirable to place a refrigerant sensor as close to a portion of the air-conditioner where refrigerant leaks are considered most likely to occur. Since the area proximate to a drain pan, i.e., immediately beneath a heat exchanger, is an area where refrigerant leaks often occur, it can be advantageous to place a refrigerant sensor proximate to the drain pan. Various configurations are described below through which a refrigerant sensor can be placed near the drain pan.

In some embodiments, there will be very little space between a drain pan and air-conditioner housing. In such an embodiment, it may be desirable to place a refrigerant sensor within a recess or indentation in the drain pan.

Figure 1:
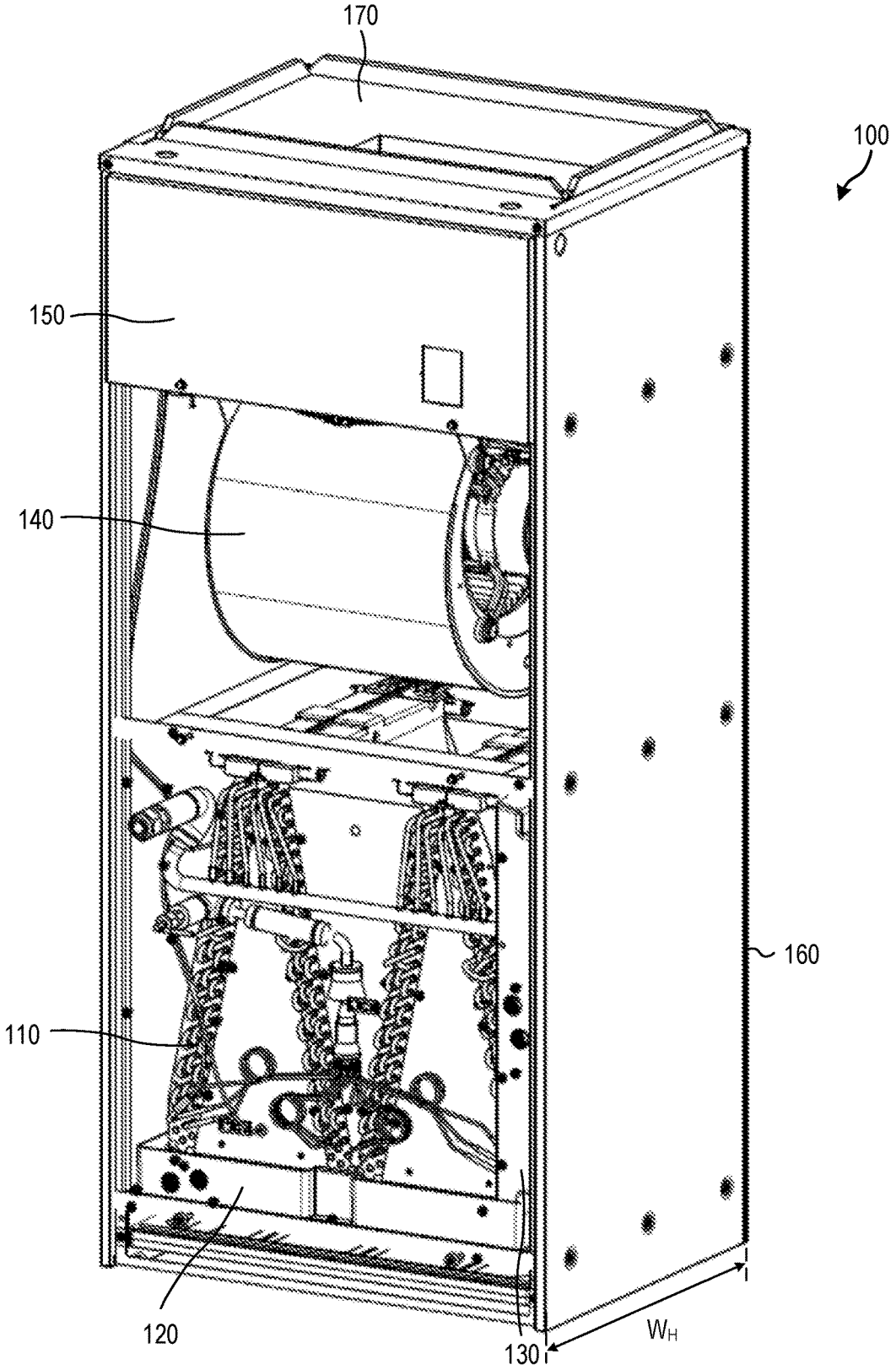
FIG. 1 is a perspective view of an air conditioner in a vertical orientation according to disclosed embodiments.

FIG. 1 is a perspective view of an air conditioner 100 in a vertical orientation according to disclosed embodiments. In a vertical orientation, air passes through the air-conditioner in a vertical direction, i.e., top-to-bottom or bottom-to-top. As shown in FIG. 1, the air-conditioner 100 includes a heat exchanger 110, a vertical drain pan 120, a horizontal drain pan 130, a fan 140, air-conditioner control circuitry 150, an air-conditioner housing 160, and a blow-out port 170.

The heat exchanger 110 is a coil-based heat exchanger such as an A-coil through which refrigerant is passed during air-conditioner operation. The refrigerant is either heated or cooled depending upon whether a heating or cooling operation is being performed, which allows the refrigerant to transfer heat with air passing across the heat exchanger 110. In the embodiment shown in FIG. 1, the heat exchanger 110 uses a double A-coil.

The coils in the heat exchanger 110 typically bend back and forth to allow a greater surface area for the air to pass over. This can mean that multiple pipe portions will be connected together, e.g., using brazing, to form the coil. When refrigerant leaks occur in the heat exchanger 110, they often occur where these pipe portions connect to each other.

During a cooling operation, the coils in the heat exchanger 110 will be cooled to a temperature below the ambient air temperature. When air is passed over these cooled coils, water may condense out of the air and form on the coils. Over time, this condensed water will drip down from the coils. Since water may damage elements in the air conditioner 100, it is generally desirable to provide a drain pan to catch dripping water from the coils and channel it away from the air conditioner 100.

Since many air conditioners can be placed in either a vertical orientation or a horizontal orientation, these air conditioners are often provided with both a vertical drain pan 120 (sometimes called a main drain pan) and a horizontal drain pan 130 (sometimes called a side drain pan). The vertical drain pan 120 is configured to catch water dripping from the heat exchanger 110 when the air conditioner 100 is in a vertical orientation; and the horizontal drain pan 130 is configured to catch water dripping from the heat exchanger 110 when the air conditioner 100 is in a horizontal orientation.

The vertical drain pan 120 is arranged in the air-conditioner 100 such that water will drip from heat exchanger 110 into the vertical drain pan 120 when the air conditioner 100 is in a vertical orientation. Because air is drawn vertically through the heat exchanger 110 in the vertical orientation, the vertical drain pan 120 will have one or more openings to allow air to pass vertically through it. When an A-coil is used for the heat exchanger 110, condensed water will flow down the sides of the A-coil toward the sides of the vertical drain pan 120 and will drip into the vertical drain pan 120 there.

When a single A-coil is used for the heat exchanger, 110, the vertical drain pan 120 will have a single opening beneath the single A-coil (e.g., in a squared donut shape). When a double A-coil is used for the heat exchanger, 110, the vertical drain pan 120 will have two openings, one beneath each A-coil with a channel or basin beneath where the two A-coils meet (e.g., in a squared figure-eight shape).

The horizontal drain pan 130 is arranged in the air-conditioner 100 such that water will drip from heat exchanger 110 into the horizontal drain pan 130 when the air conditioner 100 is in a horizontal orientation. Because air is drawn horizontally through the heat exchanger 110 in the horizontal orientation, the horizontal drain pan 130 does not require any openings in its bottom, and can extend across the entire lower side of the heat exchanger 110.

Since the horizontal orientation and the vertical orientation of the air conditioner 100 are perpendicular to each other, the vertical drain pan 120 and the horizontal drain pan 130 are typically arranged to be perpendicular to each other.

The fan 140 is provided adjacent to the heat exchanger 110 and serves to move air through the air conditioner 100. A furnace blower (not shown) can operate to either blow air across the heat exchanger 110 or draw air across the heat exchanger 110, depending upon the specific embodiment. In the embodiment of FIG. 1, the fan 140 is arranged above the heat exchanger 110. However, this is by way of example only. In alternate embodiments the fan 140 could be placed below the heat exchanger 110, or other elements could be placed between the two. In alternate embodiments the fan 140 can be located outside of the air-conditioner housing 160.

The air-conditioner control circuitry 150 includes all the electronic circuitry required to control operation of the air conditioner 100. In the embodiment of FIG. 1, the air-conditioner control circuitry 150 is located above the fan 140. However, this is by way of example only. In alternate embodiments, the air-conditioner control circuitry 150 can be placed in different locations within the air conditioner 100. In many embodiments, the air-conditioner control circuitry 150 will be placed above or adjacent to the heat exchanger 110 and drain pans 120, 130 to minimize the chance of water dripping onto the air-conditioner control circuitry 150.

The air-conditioner housing 160 is a casing that surrounds the various other components of the air conditioner 100. It can be formed of metal, plastic, or any desirable material. The air-conditioner housing 160 may include one or more openings or panels to allow access to various portions of the air conditioner 100.

The blow-out port 170 is provided on top of the air conditioner 100 and serves as a port through which air is exhausted from the air conditioner 100 when the air conditioner 100 is in a vertical orientation.

The air conditioner 100 has a housing width WH that represents a width of the housing from front to back.

Figure 2:
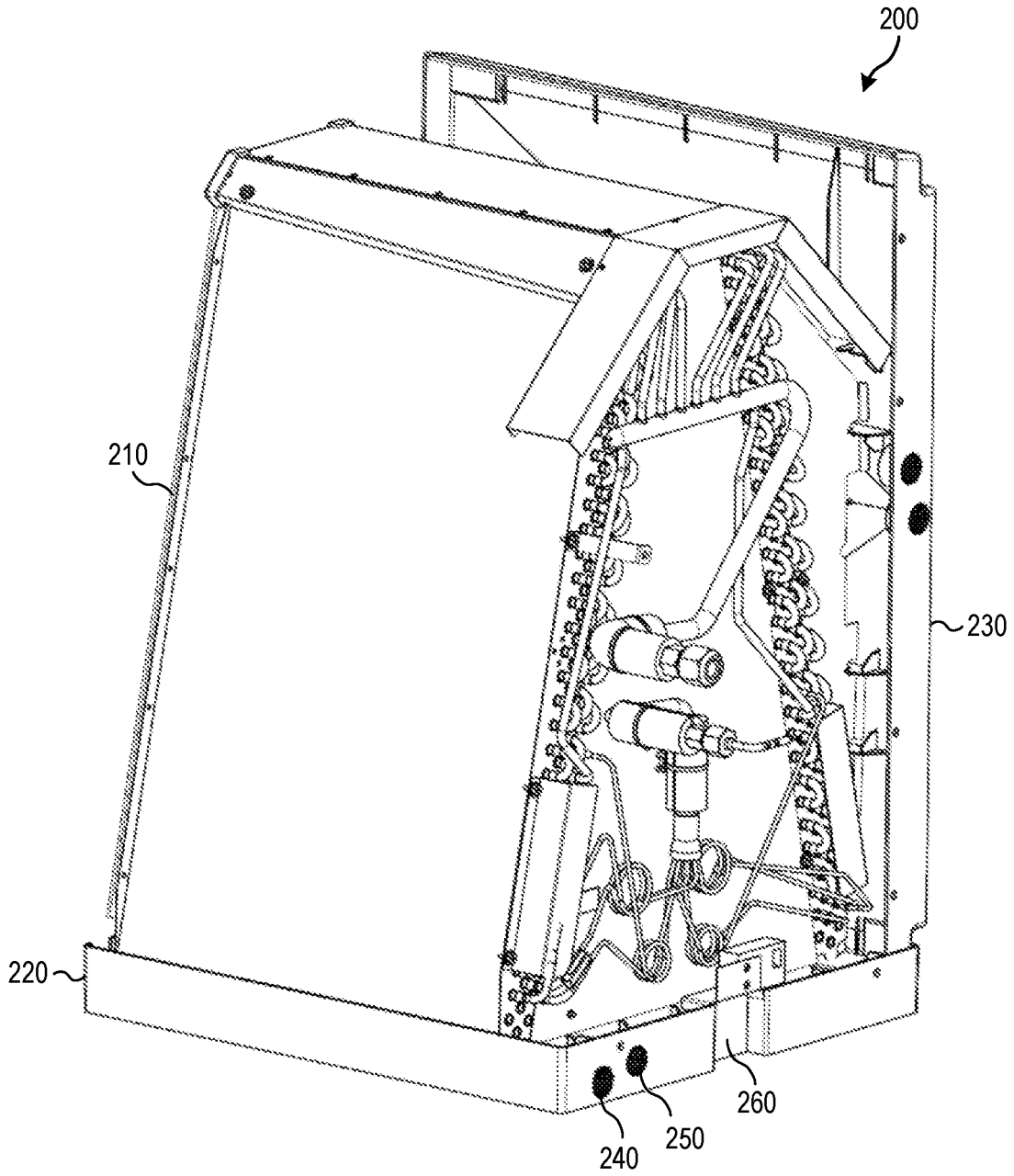
FIG. 2 is a perspective view of a heat exchanger circuit in an air conditioner according to disclosed embodiments.

FIG. 2 is a perspective view of a heat exchanger circuit 200 in an air conditioner according to disclosed embodiments. The heat exchanger circuit 200 includes a heat exchanger 210, a vertical drain pan 220, and a horizontal drain pan 230. The vertical drain pan 220 further includes a primary drain 240, an overflow drain 250, and an indentation 260.

The heat exchanger 210 corresponds to the heat exchanger 110 described above with respect to the embodiment of FIG. 1 and operates in a similar manner. However, the heat exchanger 210 in the embodiment of FIG. 2 is a single A-coil rather than a double A-coil.

The vertical drain pan 220 is arranged such that water will drip from the heat exchanger 210 into the vertical drain pan 120 when the air conditioner containing the heat exchanger 210 is in a vertical orientation. Because air is drawn vertically through the heat exchanger 210 in the vertical orientation, the vertical drain pan 220 will have an opening to allow air to pass vertically through it. During operation, condensed water can flow down the sides of the A-coil toward the sides of the vertical drain pan 220 and will collect there.

The horizontal drain pan 130 is arranged such that water will drip from heat exchanger 210 into the horizontal drain pan 230 when the air conditioner containing the heat exchanger 210 is in a horizontal orientation. Because air is drawn horizontally through the heat exchanger 210 in the horizontal orientation, the horizontal drain pan 230 does not require any openings in its bottom, and can extend across the entire lower side of the heat exchanger 210.

Since the horizontal orientation and the vertical orientation of the air conditioner containing the heat exchanger 210 are perpendicular to each other, the vertical drain pan 220 and the horizontal drain pan 230 are arranged to be perpendicular to each other. The vertical drain pan 220 in the horizontal drain pan 230 are secured to the heat exchanger 210 so that the air conditioner containing the heat exchanger 210 can be easily moved between the two orientations during installation.

The primary drain 240 is located in a side wall of the vertical drain pan 220 and provides a passage through which water can drain out of the vertical drain pan 220.

The overflow drain 250 is also located in a side of the vertical drain pan 220 and provides a second passage through which water can drain out of the vertical drain pan 220. The overflow drain 250 is placed at a location higher than primary drain 240 so that water will only flow through the overflow drain 250 when the primary drain is fully or partially filled.

Although in the embodiment of FIG. 2 the primary drain 240 and the overflow drain 250 are located on the same side wall of the vertical drain pan 220, this is by way of example only. Alternate embodiments could have primary drain 240 and the overflow drain 250 placed in different side walls of the vertical drain pan 220.

The indentation 260 is an area of the vertical drain pan 220 in which a portion of a side wall of the vertical drain pan 220 is recessed from the remainder of that side wall. This indentation 260 can be used both to contain a clip or other fastening device that will secure the heat exchanger circuit 200 in place, and to hold a refrigerant sensor.

In the embodiment of FIG. 2, three indentations 260 are provided in the vertical drain pan 220. FIG. 2 shows a first indentation 260 visible. The other two indentations 260 are on the opposite side of the vertical drain pan 220 from the visible indentation 260.

Although the embodiment disclosed in FIG. 2 includes three indentations 260, more or fewer indentations can be used in other embodiments. For example, one or more indentations 260 could be provided on each of the side walls of the vertical drain pan 220, multiple indentations 260 could be provided on a given side wall, or only a single indentation could be provided in a single side wall of the vertical drain pan 220. The number of indentations 260 on opposite walls need not be equal.

Figure 3:
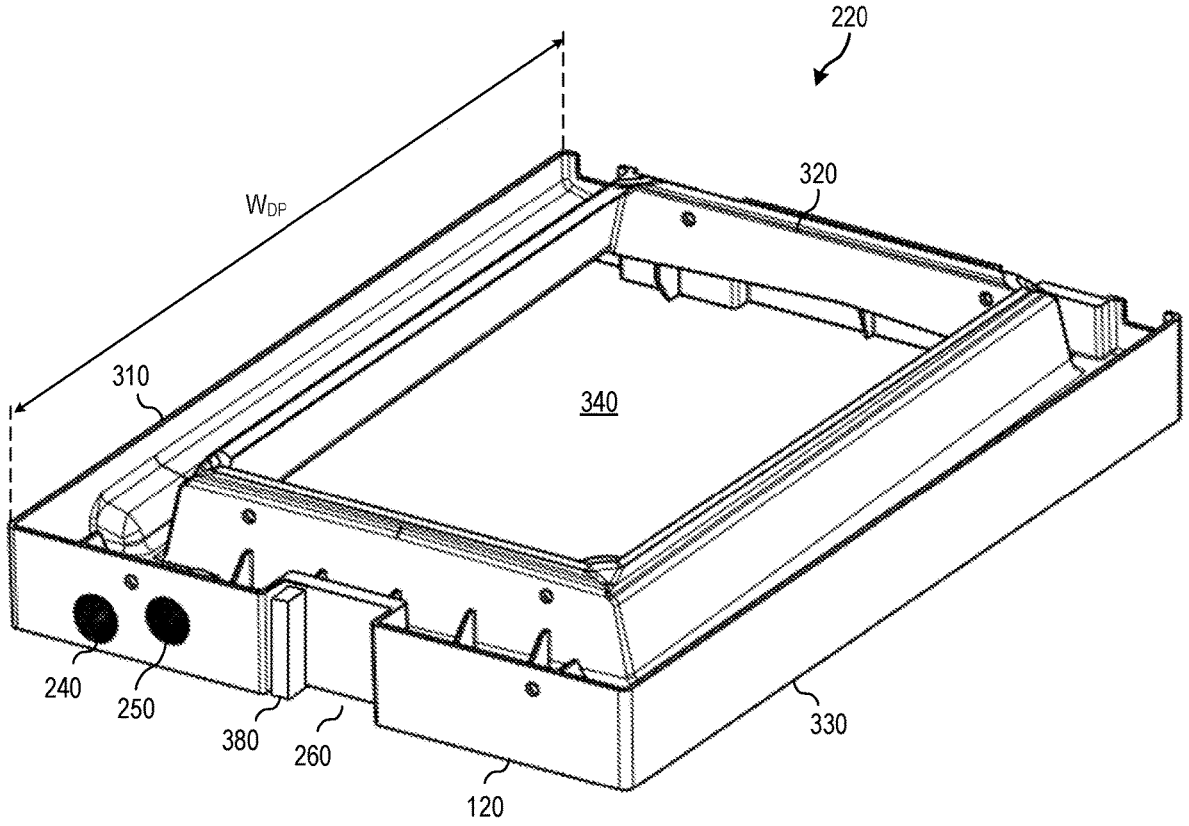
FIG. 3 is a perspective view of a vertical drain pan with a refrigerant sensor according to disclosed embodiments.

FIG. 3 is a perspective view of a vertical drain pan 220 with a refrigerant sensor according to disclosed embodiments. As shown in FIG. 3, the vertical drain pan 220 includes four outer drain pan walls 310, four inner drain pan walls 320, a drain pan bottom 330, an opening 340 between the inner drain pan walls 320, a primary drain 240, an overflow drain 250, and indentation 260, and a refrigerant sensor 380. The drain pan has a drain pan width WDP from front-to-back.

The primary drain 240, the overflow drain 250, and the indentation 260 are configured as described above with respect to the vertical drain pan 220 in FIG. 2. Their description will be omitted for the sake of brevity.

The outer drain pan walls 310 form an outer perimeter of the vertical drain pan 220. One of the outer drain pan walls 310 contains the primary drain 240 and the overflow drain 250, although this is by way of example only. The primary and overflow drains 240, 250 could be on different outer drain pan walls 310 in alternate embodiments. In addition to the drains 240, 250, one or more of the outer drain pan walls 310 may include a cut-out on the top of the outer drain pan wall 310 to channel overflow water that rises above the overflow drain 250.

The inner drain pan walls 320 form an inner perimeter of the vertical drain pan 220. In various embodiments, the inner drain pan walls 320 can be taller than the outer drain pan walls 310 and may be slanted towards the opening 340 to channel dripping water into the vertical drain pan 220.

The drain pan bottom 330 is located between the outer drain pan walls 310 and the inner drain pan walls 320 and serves, along with the outer drain pan walls 310 and the inner drain pan walls 320, to define a basin for containing dripping water.

The opening 340 is located between the inner drain pan walls 320 and allows for the passage of air through the space containing the vertical drain pan 220.

In alternate embodiments in which a double A-coil is used for the heat exchanger, 110, the vertical drain pan 220 will have two openings, one beneath each A-coil with a portion of the basin beneath where the two A-coils meet (e.g., in a squared figure-eight shape). In such an embodiment there will be two sets of inner drain pan walls 320, one surrounding each opening, with a portion of the drain pan bottom 330 between the adjacent inner drain pan walls 320 that surround the two openings.

The refrigerant sensor 380 is a circuit configured to detect the presence of refrigerant in air. It can be configured to identify a quantifiable level of refrigerant in the nearby air, or it can be configured to identify when the level of refrigerant in the nearby air rises above the threshold refrigerant level in various embodiments. In an embodiment in which the refrigerant is an A2L refrigerant, the refrigerant sensor 380 is an A2L refrigerant sensor. Alternate embodiments that use other refrigerants would have corresponding refrigerant sensors 380 that detect the refrigerants used in those embodiments.

The refrigerant sensor 380 is provided inside the indentation 260 such that it does not extend beyond the area formed by the remainder of the outer side wall in which the indentation 260 is provided. In various embodiments, refrigerant sensor 380 can have a width smaller than, the same size as, or larger than the width of the opening of the indentation 260.

In the case where the refrigerant sensor 380 has a width greater than the width of the opening of the indentation 260, the indentation 260 may be formed such that a portion of the indentation 260 has a greater width than an opening of the indentation 260. For example, the indentation may have a T-shape in which portion of the indentation 260 opposed to the opening of the indentation 260 includes a recess on one or both sides. In such an embodiment, the refrigerant sensor 380 could include portions that extend into these recesses, preventing the refrigerant sensor 380 from slipping out through the opening in the indentation 260.

Furthermore, although the refrigerant sensor 380 is placed in the indentation 260, some embodiments can provide sufficient space in the indentation 260 for a clip or other securing mechanism to also fit within the indentation 260. For example, the refrigerant sensor 380 could have a depth smaller than the depth of the indentation 260. This would leave some portion of the depth of the indentation 260 free to contain the clip or other securing mechanism.

In some embodiments, the refrigerant sensor 380 could be slid into the indentation 260 from above the vertical drain pan 220 during installation. Then, during operation, the refrigerant sensor 380 would be secured within the indentation 260 and could not easily fall out.

By placing the refrigerant sensor 380 in the indentation 260, these embodiments can ensure that the refrigerant sensor 380 can fit in the air conditioner even if there is insufficient gap adjacent to the vertical drain pan 220 to contain the refrigerant sensor 380.

Refrigerant Sensor Located Between the Drain Pan and a Housing

Some embodiments of air conditioners will include space between the drain pan and either the housing or other elements within the air conditioner. This is particularly true when an air conditioner is in a horizontal orientation in which the various elements of the air conditioner are arranged side-by-side.

Figure 4:
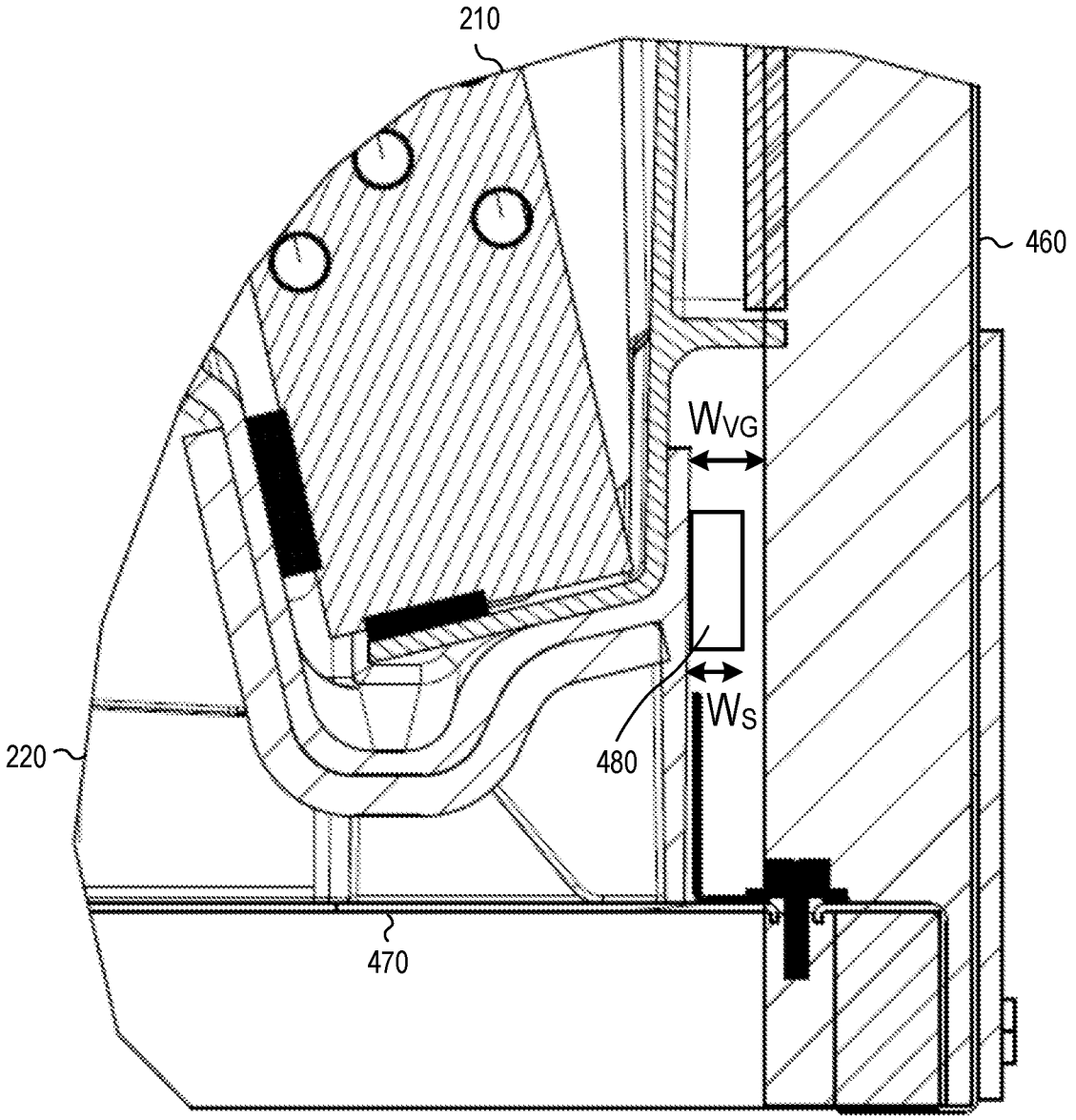
FIG. 4 is a side view of a vertical drain pan with a refrigerant sensor according to disclosed embodiments.

FIG. 4 is a side view of a vertical drain pan 220 with a refrigerant sensor 480 according to disclosed embodiments. As shown in FIG. 4, the disclosed system includes a heat exchanger 210, a vertical drain pan 220, an air conditioner housing 460, a shelf 470, and a refrigerant sensor 480.

The heat exchanger 210 and the vertical drain pan 220 operate as described above with respect to FIG. 2. Their description will be omitted for the sake of brevity.

As shown in FIG. 4, the heat exchanger 210 rests along one side of the vertical drain pan 220, where it may be secured in place.

The air-conditioner housing 460 corresponds to the air conditioner housing 160 described with respect to FIG. 1. Specifically, the air conditioner housing 460 surrounds the other elements in the air conditioner. It may be made of metal, plastic, or any appropriate material.

The shelf 470 is provided within the air-conditioner housing 460 and serves as a place for the vertical drain pan 220 to rest. In various embodiments the vertical drain pan 220 may be secured to the shelf 470 or it may simply rest on top of the shelf 470.

The refrigerant sensor 480 is a circuit configured to detect the presence of refrigerant in air. It can be configured to identify a quantifiable level of refrigerant in the nearby air, or it can be configured to identify when the level of refrigerant in the nearby air rises above the threshold refrigerant level in various embodiments. In an embodiment in which the refrigerant is an A2L refrigerant, the refrigerant sensor 480 is an A2L refrigerant sensor.

The refrigerant sensor 480 is provided in a space between the vertical drain pan 220 and the air-conditioner housing 460. As shown FIG. 4, a gap between the vertical drain pan 220 and the air-conditioner housing 460 has a vertical gap width WVG and the refrigerant sensor 480 has a sensor width WS. For the refrigerant sensor 480 to fit within the gap, the vertical gap width WVG must be greater than or equal to the sensor width WS.

In the embodiment of FIG. 4, the refrigerant sensor 480 is attached to the vertical drain pan 220. However, this is by way of example only. In other embodiments, the refrigerant sensor 480 could be attached to the air-conditioner housing 460, the shelf 470, could be held by pressure between the vertical drain pan 220 and the air-conditioner housing 460 (e.g., using one or more springs or the like), or could be held in place by any other suitable means for securing the refrigerant sensor between the vertical drain pan 220 and the air-conditioner housing 460.

Figure 5:
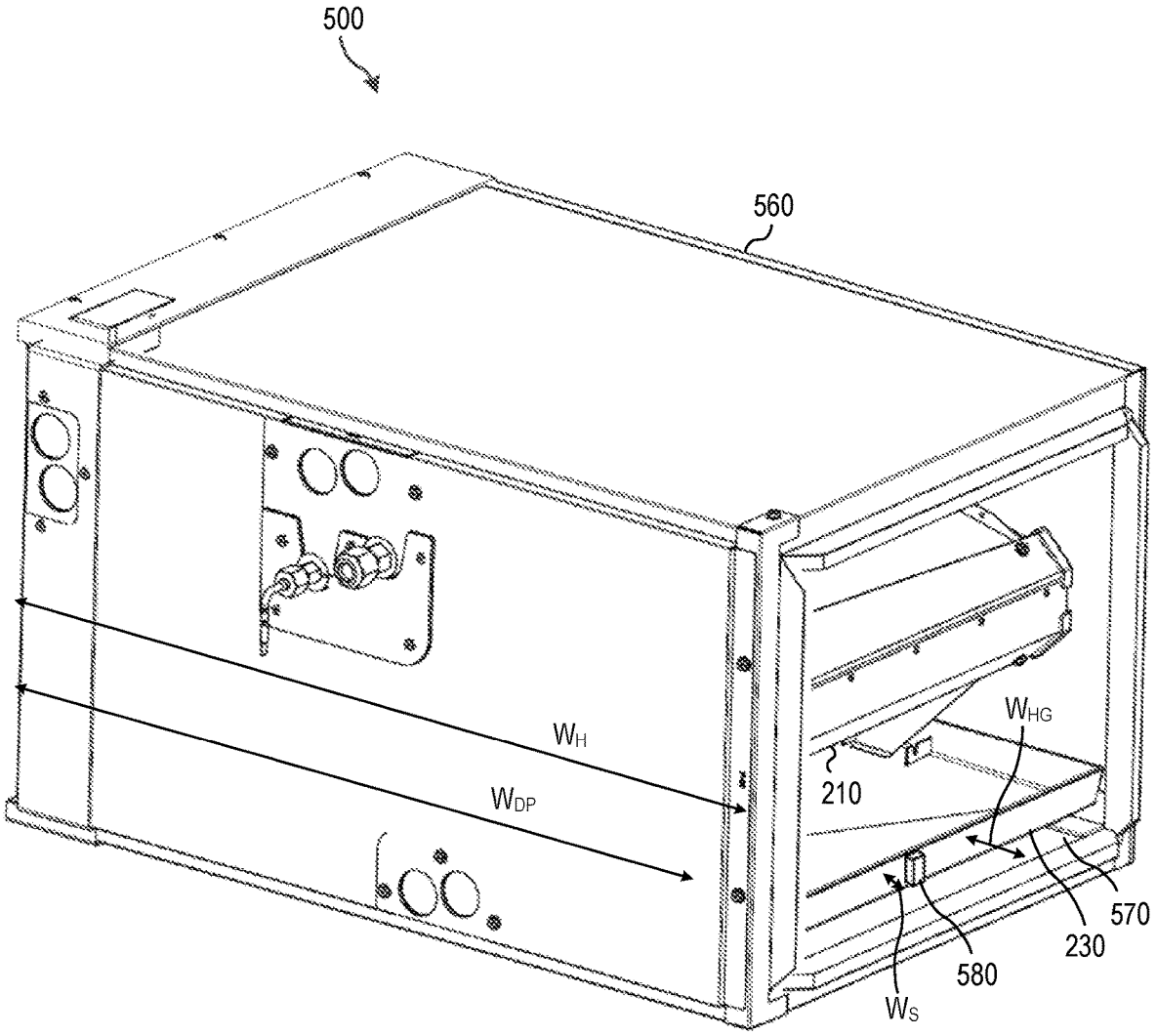
FIG. 5 is a perspective view of an air conditioner in a horizontal orientation with a refrigerant sensor according to disclosed embodiments.

FIG. 5 is a perspective view of an air conditioner 500 in a horizontal orientation with a refrigerant sensor 580 according to disclosed embodiments. As shown in FIG. 5, the air conditioner 500 includes a heat exchanger 210, a horizontal drain pan 230, an air-conditioner housing 560, a blow-out port 570, and a refrigerant sensor 580.

The heat exchanger 210 and the vertical drain pan 220 operate as described above with respect to FIG. 2. Their description will be omitted for the sake of brevity. As shown in FIG. 5, the heat exchanger 210 is secured above the horizontal drain pan 230.

The air-conditioner housing 560 corresponds to the air conditioner housing 160 described with respect to FIG. 1. Specifically, the air-conditioner housing 560 surrounds the other elements in the air conditioner 500. It may be made of metal, plastic, or any appropriate material.

The refrigerant sensor 580 is a circuit configured to detect the presence of refrigerant in air. It can be configured to identify a quantifiable level of refrigerant in the nearby air, or it can be configured to identify when the level of refrigerant in the nearby air rises above the threshold refrigerant level in various embodiments. In an embodiment in which the refrigerant is an A2L refrigerant, the refrigerant sensor 580 is an A2L refrigerant sensor.

The blow-out port 570 is an opening in the air-conditioner housing 560 through which air passing over the heat exchanger 210 is blown out of the air conditioner 500. Since the air conditioner 500 is in a horizontal orientation, the blow-out port is to the side of the heat exchanger 210 and horizontal drain pan 230.

The refrigerant sensor 580 is provided in a space between the horizontal drain pan 230 and the air-conditioner housing 560. In the embodiment of FIG. 5, the refrigerant sensor 588 is specifically provided between the horizontal drain pan 230 and the blow-out port 570. However, this is by way of example only. In alternate embodiments the refrigerant sensor 580 could be connected to between the horizontal drain pan 230 and any portion of the air-conditioner housing 560 for which there was a gap between the horizontal drain pan 230 and the air-conditioner housing 560.

As shown in FIG. 5, a gap between the horizontal drain pan 230 and the end of the blow-out port 570 has a horizontal gap width WHG and the refrigerant sensor 580 has a sensor width WS. For the refrigerant sensor 580 to fit within the gap, the horizontal gap width WHG must be greater than or equal to the sensor width WS.

In the embodiment of FIG. 5, the refrigerant sensor 580 is attached to the horizontal drain pan 230. However, this is by way of example only. In other embodiments, the refrigerant sensor 580 could be attached to the air-conditioner housing 560, could be attached to a shelf on which the horizontal drain pan 230 rests, could be held by pressure between the horizontal drain pan 230 and a portion of the air-conditioner housing 560 (e.g., using one or more springs or the like), or could be attached using any other suitable means for securing the refrigerant sensor between the horizontal drain pan 230 and the air-conditioner housing 560 including the blow-out port 570.

By placing the refrigerant sensor 480, 580 between the horizontal drain pan 230 and the air-conditioner housing 460, 560, these embodiments can ensure that the refrigerant sensor 480, 580 can fit in the air conditioner and also remain located near where refrigerant leaks are most likely, i.e., close to the heat exchanger.

Refrigerant Sensor Casing

Since refrigerant sensors are electronic devices, it is preferable to protect them from having water splashed upon them. This is of particular concern when the refrigerant sensors are located adjacent to a drain pan 220, 230, specifically when they are located in an area next to a wall of the drain pan 220, 230 over which water could splash or overflow.

In addition, since the primary function of a refrigerant sensor 480, 580 is to detect a refrigerant in the air, it can be desirable to channel air coming down past from the top of a drain pan 220, 230 past the refrigerant sensor 480, 580. Since the refrigerant is typically heavier than air, it will naturally fall downward from above the drain pan 220, 230 and past the refrigerant sensor 480, 580.

It can therefore be advantageous in some embodiments to provide a refrigerant sensor casing that channels air from above toward the refrigerant sensor 480, 580 and traps the air (and any refrigerant in the air) near the refrigerant sensor 480, 580.

Figure 6:
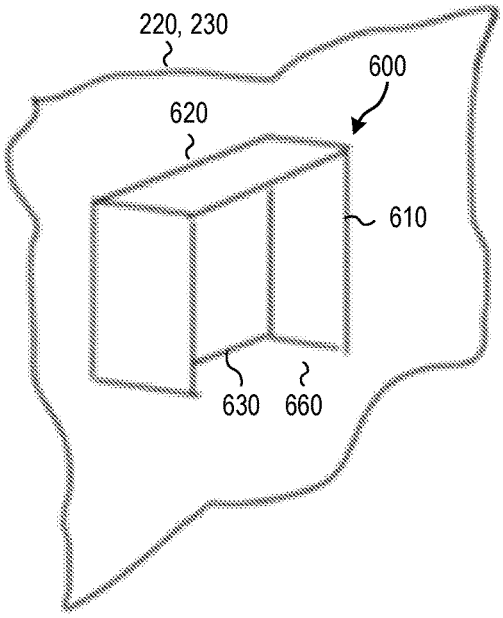
FIG. 6 is a perspective view of a refrigerant sensor casing according to disclosed embodiments.

FIG. 6 is a perspective view of a refrigerant sensor casing 600 according to disclosed embodiments. As shown in FIG. 6, the refrigerant sensor casing 600 is attached to a drain pan 220, 230, and includes two or more side walls 610, a top wall 620, and a back wall 630.

The side walls 610 and the back wall 630 are formed substantially vertically, while the top wall 620 is formed substantially horizontally. The side wall 610, the top wall 620, and the back wall 630 are connected together to form a protected area 660 into which a refrigerant sensor 480, 580 (not shown) can be placed. In this protected area 660 the bottom is open to air and the side opposite the back wall is also open to air.

Although the refrigerant sensor casing 600 is shown as being rectangular in shape, this is by way of example only. Any of the walls of the refrigerant sensor casing 600 could be curved and the cross-section of the refrigerant sensor casing 600 can be any desired shape. For example, the top wall 620 could be curved or angled to allow water to more easily drip off of it.

The back wall 630 of the sensor casing 600 could be used to secure the sensor casing 600 to the drain pan 220, 230. In some embodiments, the back wall 630 could be omitted.

The refrigerant sensor casing 600 can be made of metal, plastic or any suitable material. However, a material that will not be corroded by water is preferred. The refrigerant sensor casing 600 should have a width smaller than a gap between the drain pan 220, 230 and an air-conditioner housing 460, 560.

By placing the refrigerant sensor casing 600 around a refrigerant sensor 480, 580, a device in this embodiment can further protect the refrigerant sensor 480, 580 from being damaged by water either dripping from a heat exchanger 210 or spilling over from a drain pan 220, 230.

Although FIG. 6 discloses the refrigerant sensor casing 600 being attached to a drain pan 220, 230, this is by way of example only. Alternate embodiments could attach the refrigerant sensor casing 600 to an air-conditioner housing 460, 560, to a shelf, or to any suitable structure within the air-conditioner.

Figure 7:
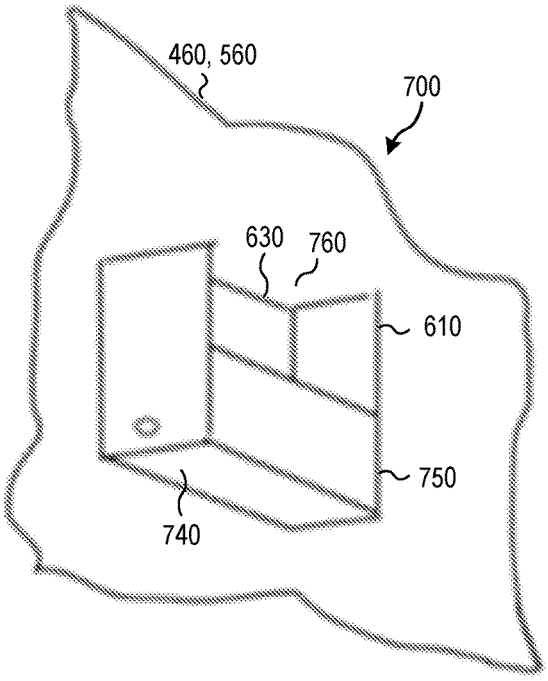
FIG. 7 is a perspective view of a refrigerant sensor casing according to alternate disclosed embodiments.

FIG. 7 is a perspective view of a refrigerant sensor casing 700 according to alternate disclosed embodiments. As shown in FIG. 7, the refrigerant sensor casing 700 is attached to an air-conditioner housing 460, 560, and includes two or more side walls 610, a back wall 630, a bottom wall 740, and a front wall 750.

The side walls 610, the back wall 630, and the front wall 750 are formed substantially vertically, while the bottom wall 740 is formed substantially horizontally. The side wall 610, the back wall 630, the bottom wall 740, and the front wall 750 are connected together to form a protected area 760 into which a refrigerant sensor 480, 580 (not shown) can be placed. In this protected area 760 the top and part of the front is open to air.

In the embodiment of FIG. 7, the front wall 750 only extends partially down the length of the side walls 610. This creates an open portion above the front wall 750 and an area enclosed on four sides and the bottom where the front wall is formed. Since refrigerant is typically heavier than air, refrigerant-filled air falling from above may collect in this area making it easier to detect refrigerant in the air. It is not necessary to have the front wall 750 extend along the whole length of the side walls 610 to allow for additional air flow. Alternate embodiments can choose any desirable length for the front wall 750, including having it be the same length as the side walls 610 or even longer.

Although the refrigerant sensor casing 700 is shown as being rectangular in shape, this is by way of example only. Any of the walls of the refrigerant sensor casing 700 could be curved and the cross-section of the refrigerant sensor casing 700 can be any desired shape. For example, the top wall 620 could be curved or angled to allow water to more easily drip off it.

The back wall 630 of the sensor casing 700 could be used to secure the sensor casing 700 to the air-conditioner housing 460, 560. In some embodiments, the back wall 630 could be omitted.

The refrigerant sensor casing 700 can be made of metal, plastic or any suitable material. However, a material that will not be corroded by water is preferred. The refrigerant sensor casing 700 should have a width smaller than a gap between the drain pan 220, 230 and an air-conditioner housing 460, 560.

By placing the refrigerant sensor casing 700 around the refrigerant sensor 480, 580, a device in that this embodiment can increase the effectiveness of a refrigerant sensor 480, 580 placed in the protected area 760.

Although FIG. 7 discloses the refrigerant sensor casing 700 being attached to an air-conditioner housing 460, 560, this is by way of example only. Alternate embodiments could attach the refrigerant sensor casing 700 to a drain pan 220, 230, to a shelf, or to any suitable structure within the air-conditioner.

Alternate embodiments could also combine the embodiments of FIGS. 6 and 7. For example, one embodiment could include a narrower top wall 620 that will deflect some dripping water but will allow air to flow past it.

Refrigerant Sensor Located in in a Well in the Drain Pan

Since the drain pans 220, 230 have different ways through which water can escape the water cannot rise higher than a certain level in a drain pan 220, 230. As a result, it is also possible to create an area within a the bounds drain pan 220, 230 into which a refrigerant sensor could be placed.

Figure 8:
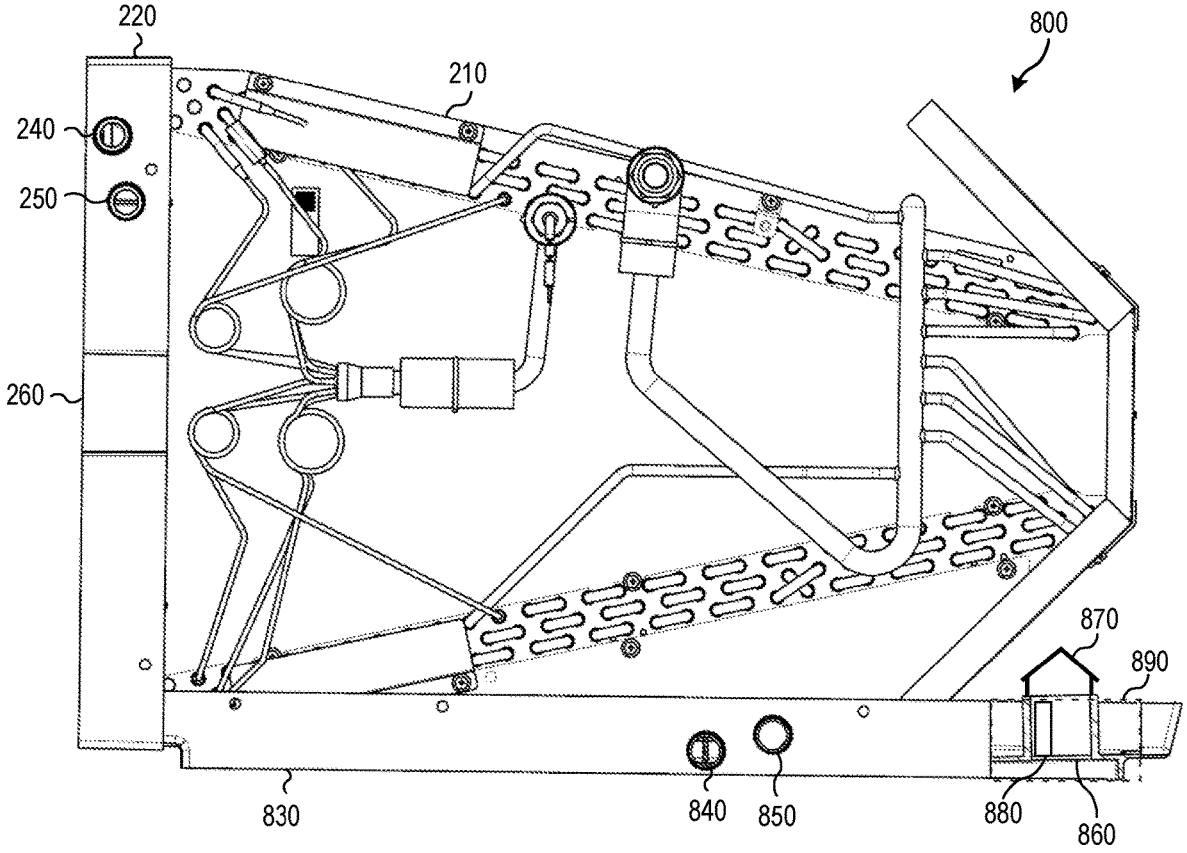
FIG. 8 is a side view of a heat exchanger and a horizontal drain pan having a well according to disclosed embodiments.

FIG. 8 is a side view of a heat exchanger system 800 heat exchanger 210 and a horizontal drain 830 pan having a well 860 according to disclosed embodiments. As shown in FIG. 8, the heat exchanger system 800 includes a heat exchanger 210, a vertical drain pan 220, and a horizontal drain pan 830. The vertical drain pan 220 includes a primary drain 240, an overflow drain 250, and an indentation 260. The horizontal drain pan 830 includes a primary drain 840, an overflow drain 850, a well 860, a covering 870, and a refrigerant sensor 880.

An area 890 is provided in FIG. 8 where the wall of the horizontal drain pan 830 is not shown. This is merely for the sake of disclosure and better understanding of the structure of the horizontal brainpan 830. This portion of the wall of the horizontal brainpan 830 is not removed but is merely shown as being transparent in FIG. 8 so that the well 860 can be seen. Furthermore, a portion of the side of the well 860 is not shown in FIG. 8 so that the interior of the well 860 can be observed.

The heat exchanger 210 and the vertical drain pan 220 operate as described above with respect to FIG. 2. Their description will be omitted for the sake of brevity.

The primary drain 840 and the overflow drain 850 operate in a manner comparable to the primary drain 240 and the overflow drain 250 in the vertical drain pan 220.

The well 860 is an area between the outer walls of the horizontal drain pan 830 that is defined by walls that isolate the area inside the well 860 from the portions of the horizontal drain pan 830 that contain water.

In the embodiment of FIG. 8, the well 860 is oval in cross-section. However this is by way of example only. The cross-section of the well could also be circular, rectangular, square, or any suitable shape. In some embodiments it may be an irregular shape to allow it to fit into a specific place within the horizontal drain pan 830.

The walls of the well 860 should be sufficiently high that water from the horizontal drain pan 830 will not spill into the well 860. One way to achieve this is to make sure they are higher than the overflow drain 850, higher than the walls of the horizontal drain pan 830, or higher than an opening in the walls of the horizontal drain pan 830 through which overflow water can be directed.

The well 860 may also include a hole in the bottom, which can allow water to drain from the well 860 should any accidentally fall into the well 860 and may allow for a wire from the refrigerant sensor 880 to pass to an air-conditioner controller or other circuitry.

The covering 870 is formed over the well 860 and may be in the shape of a pagoda or umbrella. It serves to deflect any water dripping down over the well 860 and prevent the water from falling into the well 860. In some embodiments, the cross-section of the covering 870 may be larger than the cross-section of the well 860 such that the edge of the covering 870 extends past the edge of the well 860. In this way water dripping off the covering 870 will fall away from the opening of the well 860.

The covering 870 is arranged such that air can enter into the well 860. For example, the covering 870 may protrude from the well by stilts that leave an area between the covering 870 and the opening of the well 863 through which air can pass. Because the refrigerant sensor 880 operates to detect refrigerant leaks in the air proximate to the horizontal drain pan 830, it is necessary to provide an avenue for such air to reach the refrigerant sensor 880.

The refrigerant sensor 880 is a circuit configured to detect the presence of refrigerant in air. It can be configured to identify a quantifiable level of refrigerant in the nearby air, or it can be configured to identify when the level of refrigerant in the nearby air rises above the threshold refrigerant level in various embodiments. In an embodiment in which the refrigerant is an A2L refrigerant, the refrigerant sensor 880 is an A2L refrigerant sensor.

In some embodiments, the well 860 is located closer to a portion of the horizontal drain pan 830 where brazed portions of the heat exchanger 210 are located. Since areas where two pipe portions in the heat exchanger 210 are brazed is more likely to have a refrigerant leak than other portions of the air conditioner, this places the refrigerant sensor 880 closer to a portion of the air conditioner where a leak is more likely, which increases the chance of detecting leak early.

Although FIG. 8 discloses the well 860 as being in the horizontal drain 830, alternate embodiments could place a well inside the vertical drain pan 220 as well.

Figure 9:
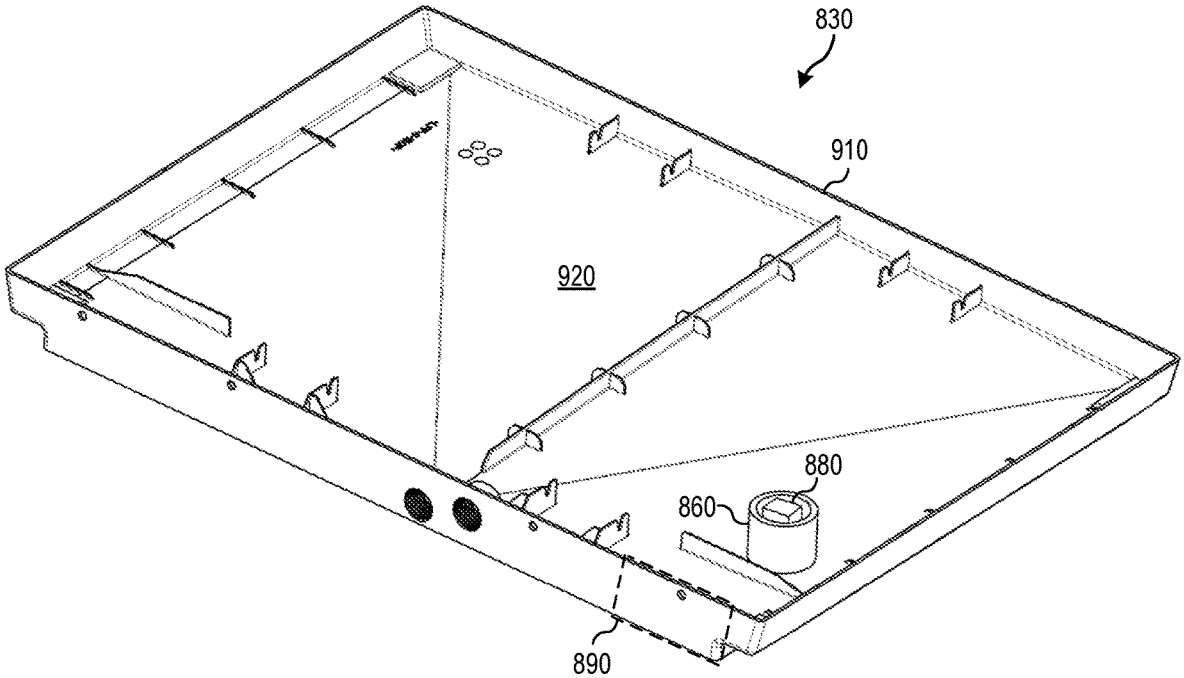
FIG. 9 is a perspective view of the horizontal drain pan of FIG. 8 according to disclosed embodiments.

FIG. 9 is a perspective view of the horizontal drain pan 830 of FIG. 8 according to disclosed embodiments. As shown in FIG. 9, of the horizontal drain pan 830 is defined by a plurality of sidewalls 910 and a bottom surface 920. The sidewalls 910 and the bottom surface 920 of the horizontal drain pan 830 are connected to form a basin for catching water that drips from a heat exchanger 210.

The well 860 is formed to protrude from the bottom surface 920 of the horizontal drain pan 830, and the refrigerant sensor 880 is formed inside the well 860.

For ease of understanding of the configuration of the well 860 and the refrigerant sensor 880, the covering 870 is not shown in FIG. 9.

In alternate embodiments, the well 860 can protrude through the bottom of the horizontal drain pan 830, in which case the well could have a bottom of its own at a level below the bottom of the horizontal drain pan 830. In other embodiments, the well 860 could have an open bottom.

Conclusion

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

The invention claimed is:

1. An air conditioner,
comprising:
a drain pan including
plurality of drain pan walls forming an outer circumference of the drain pan, and
a drain pan bottom, connected to each of the plurality of drain pan walls such that the plurality of drain pan walls and the drain pan bottom form a basin capable of collecting liquid;
a refrigerant sensor located proximate to a first outer surface of a first drain pan wall selected from the plurality of drain pan walls, the refrigerant sensor being configured to detect refrigerant in air proximate to the drain pan; and
an air-conditioner housing containing the drain pan,
wherein
the drain pan has a first drain pan width in a first direction,
the air-conditioner housing has a first housing width in the first direction,
the refrigerant sensor has a first sensor width in the first direction,
the refrigerant sensor and the drain pan are arranged along a line in the first direction,
a sum of the first drain pan width and the first sensor width is less than the first housing width, and
the refrigerant sensor is arranged in between the first drain pan wall and the air-conditioner housing and is held in place by pressure between the first drain pan wall and the air-conditioner housing.

2. An air conditioner,
comprising:
a drain pan including
plurality of drain pan walls forming an outer circumference of the drain pan,
a drain pan bottom, connected to each of the plurality of drain pan walls such that the plurality of drain pan walls and the drain pan bottom form a basin capable of collecting liquid, and
a well connected to the drain pan bottom, the well forming an internal space separate from the basin, such that the liquid in the basin cannot pass into the internal space;
a refrigerant sensor formed in the well; and
an air-conditioner housing containing the drain pan,
wherein
the drain pan has a first drain pan width in a first direction,
the air-conditioner housing has a first housing width in the first direction,
the refrigerant sensor has a first sensor width in the first direction,
the refrigerant sensor and the drain pan are arranged along a line in the first direction,
a sum of the first drain pan width and the first sensor width is less than the first housing width, and
the drain pan further includes a well covering formed over the well such that liquid cannot drip from above the well into the internal space, and
the well covering is formed to allow air to pass from the drain pan into the well.

3. An air conditioner,
comprising:
a drain pan including
plurality of drain pan walls forming an outer circumference of the drain pan,
a drain pan bottom, connected to each of the plurality of drain pan walls such that the plurality of drain pan walls and the drain pan bottom form a basin capable of collecting liquid, and
a well connected to the drain pan bottom, the well forming an internal space separate from the basin, such that the liquid in the basin cannot pass into the internal space;
a refrigerant sensor formed in the well; and
an air-conditioner housing containing the drain pan,
wherein
the drain pan has a first drain pan width in a first direction,
the air-conditioner housing has a first housing width in the first direction,
the refrigerant sensor has a first sensor width in the first direction,
the refrigerant sensor and the drain pan are arranged along a line in the first direction,
a sum of the first drain pan width and the first sensor width is less than the first housing width,
the drain pan further includes
a main drain configured to allow the liquid to pass out of the basin, and
an auxiliary drain configured to allow the liquid to pass out of the basin, the auxiliary drain being located at a position higher than the main drain, and
a top of the well is higher than the auxiliary drain.

4. The air conditioner recited in claim 1, further comprising:
a sensor casing attached to the first drain pan wall, the sensor casing being configured to at least partially enclose the refrigerant sensor.

5. The air conditioner recited in claim 4, wherein
the sensor casing includes
a casing top wall formed above the refrigerant sensor, and
at least one casing side wall formed adjacent to the refrigerant sensor at a level below the casing top wall.

6. The air conditioner recited in claim 5, wherein
the sensor casing further includes
a casing front wall formed adjacent to the refrigerant sensor at a level below the casing top wall, the casing front wall being substantially parallel to the first drain pan wall and being attached to at least one of the casing top wall and the at least one casing side wall.

7. The air conditioner recited in claim 4, wherein
the sensor casing includes
a casing bottom wall formed below the refrigerant sensor, and
at least one casing side wall formed adjacent to the refrigerant sensor at a level above the casing bottom wall.

8. The air conditioner recited in claim 7, wherein
the sensor casing further includes
a casing front wall formed adjacent to the refrigerant sensor at a level above the casing bottom wall, the casing front wall being substantially parallel to the first drain pan wall and being attached to at least one of the casing bottom wall and the at least one casing side wall.

9. The air conditioner recited in claim 1, further comprising:

a shelf located inside the air-conditioner housing and beneath the drain pan upon which the drain pan rests, wherein the refrigerant sensor is attached to the shelf.

10. The air conditioner recited in claim 9, further comprising:

a sensor casing attached to the shelf, the sensor casing being configured to at least partially enclose the refrigerant sensor.

11. The air conditioner recited in claim 1, further comprising a heat exchanger formed above the drain pan.

12. The air conditioner recited in claim 1, wherein the refrigerant sensor is arranged in between the first drain pan wall and the air-conditioner housing and is held in place by pressure between the first drain pan wall and the air-conditioner housing.

13. The air conditioner recited in claim 1, wherein the air-conditioner housing includes an access panel on a first housing wall, the first direction is substantially perpendicular to a widest surface of the access panel, and the refrigerant sensor is located between the drain pan and the access panel.

14. The air conditioner recited in claim 1, wherein the refrigerant sensor is attached to the first outer surface of the first drain pan wall.

15. The air conditioner recited in claim 1, wherein the refrigerant sensor is attached to the air-conditioner housing.

16. The air conditioner recited in claim 2, the drain pan further includes a main drain configured to allow the liquid to pass out of the basin, and an auxiliary drain configured to allow the liquid to pass out of the basin, the auxiliary drain being located at a position higher than the main drain, and a top of the well is higher than the auxiliary drain.

17. The air conditioner recited in claim 2, wherein the well has an oval cross section in a plane parallel to a plane of the drain pan bottom.

18. The air conditioner recited in claim 2, wherein the well includes an opening on a bottom surface of the well.

19. The air conditioner recited in claim 3, wherein the well has an oval cross section in a plane parallel to a plane of the drain pan bottom.

20. The air conditioner recited in claim 3, wherein the drain pan further includes a well covering formed over the well such that liquid cannot drip from above the well into the internal space, and the well covering is formed to allow air to pass from the drain pan into the well.

* * * * *